US006042219A

United States Patent [19]

Higashino et al.

[11] Patent Number: 6,042,219

[45] Date of Patent: Mar. 28, 2000

[54] INK-JET RECORDING HEAD

[75] Inventors: Kusunoki Higashino, Osaka; Shoichi Minato; Naoki Matsui, both of Sakai, all of Japan

[73] Assignee: Minolta Co., Ltd., Osaka, Japan

[21] Appl. No.: 08/908,489

[22] Filed: Aug. 7, 1997

[30] Foreign Application Priority Data

| | | | |
|---|---|---|---|
| Aug. 7, 1996 | [JP] | Japan | 8-208515 |
| Apr. 9, 1997 | [JP] | Japan | 9-090786 |

[51] Int. Cl.[7] ..... B41J 2/135; B41J 2/14

[52] U.S. Cl. ..... 347/47; 347/45; 347/15

[58] Field of Search ..... 347/45, 47, 15

[56] References Cited

U.S. PATENT DOCUMENTS

| | | | |
|---|---|---|---|
| 4,369,455 | 1/1983 | McConica et al. | 347/11 |
| 4,454,519 | 6/1984 | Oosaka et al. | 347/45 |
| 4,503,444 | 3/1985 | Tacklind | 347/11 |
| 4,587,534 | 5/1986 | Saito et al. | 347/47 |
| 4,890,126 | 12/1989 | Hotomi | 347/45 |
| 5,208,605 | 5/1993 | Drake | 347/15 |
| 5,350,616 | 9/1994 | Pan et al. | 347/45 |
| 5,412,410 | 5/1995 | Rezanka | 347/15 |

FOREIGN PATENT DOCUMENTS

| | | |
|---|---|---|
| 0437062 | 7/1991 | European Pat. Off. . |
| 4-339656 | 11/1992 | Japan . |
| 2282992 | 4/1995 | United Kingdom . |

*Primary Examiner*—John Barlow
*Assistant Examiner*—Christina Annick
*Attorney, Agent, or Firm*—Sidley & Austin

[57] ABSTRACT

An ink-jet recording head (10) includes a first head member (16*a*) in which a first nozzle (30) is formed, and a second head member (16*b*) in which a second nozzle (30) is formed. The first and second head members (16*a*,16*b*) are made of materials having different repellent characteristics against ink material. Even if the first and second nozzle have the same size, ink droplets ejected from the first and second nozzles (30) have respective diameters. This enables the ink-jet head (10) to eject ink droplets having various sizes to print a highly graded halftone image.

10 Claims, 6 Drawing Sheets

INK-JET RECORDING HEAD

FIELD OF THE INVENTION

The invention relates to an ink-jet recording head for use in an Drop-On-Demand ink-jet recording device in which a number of ink-droplets are ejected in response to an image signal and then deposited on a recording medium such as plain paper to reproduce a visible image corresponding to the image signal.

BACKGROUND OF THE INVENTION

There have been known a variety of ink-jet recording devices in which a number of ink droplets are ejected in response to an image signal and then deposited onto a recording medium such as plain paper to reproduce a visible image corresponding to the image signal. To reproduce as many images as possible in a relatively short span of time and to provide the resultant images with an elevated quality, it has been understood that it is effective to change diameter of ink dots to provide the resultant image with a tone gradation.

For this purpose, an amount or volume of ink material to be ejected from nozzles must be controlled in accordance with the tone gradation. Thus, in the past, it has been proposed an ink-jet recording device in which a plurality of ink-jet heads are incorporated. In this recording device, a diameter of the nozzle in one ink-jet head is determined to have a different size from that of another ink-jet head, enabling the device to eject different sizes of ink droplets.

The technique is useful to some extent, however, it cannot significantly expand the gradation range and, therefore, a sufficient tone gradation required for printing a picture-like halftone image with a smooth change could not be achieved.

SUMMARY OF THE INVENTION

Accordingly, a primary objet of the invention is to provide an improved ink-jet recording head for use in the Drop-On-Demand ink-jet recording device.

For this purpose, an ink-jet recording head of the present invention comprises a first head member in which a first nozzle is formed and a second head member in which a second nozzle is formed. Also, the first and second head members are made of materials having different ink repellent characteristics.

In this instance, even if the first and second nozzle have the same size, ink droplets ejected from the first and second nozzles have different diameters, which enables the ink-jet head to eject ink droplets having various sizes to print a highly graded halftone image.

Ink repellent characteristics of the head member material relative to the ink may be quantified in terms of angle of contact between the ink and the head member material. Using this approach, a high angle of contact corresponds to a situation where the ink is repelled by the head member material and a low angle of contact corresponds to a situation where the ink tends to wet the head member material.

Preferably, a difference of the ink repellent characteristics of the first and second head members is five degrees or more in terms of a contact angle against the ink material. In this case, a difference of the diameters of the ink droplets ejected from the first and second nozzles will be more distinct.

The first and second nozzles may have the same or different diameters. In a case where the first and second nozzles have different sizes, the difference between the sizes of the ink droplets ejected from the first and second nozzles is increased, thereby increasing the tone gradation of the halftone image. In particular, a recording head with different size nozzles provides the head with a wider range of tone gradation than one having the same size nozzles with different ink repellent characteristics.

In another aspect of the invention, an ink-jet recording head of the present invention comprises a head member in which a nozzle through which the ink material is ejected is formed. In this head, a first surface portion which extends around and adjacent to a distal end of the nozzle and a second surface portion on the nozzle adjacent to the first surface portion have different contact angles against the ink material.

Preferably, the contact angle of the first surface portion is greater than that of the second head portion.

More preferably, the first surface portion may be formed of polyimide while the second surface portion of nickel.

With this arrangement, the ink material is well settled in the nozzle and therefore no ink drops or leaks due to a residual vibration of the nozzle that may occur after the ink ejection. Also, this prevents a scattering of small ink droplets and an oblique propelling of the ink droplet. Further, a number of ink droplets can be ejected without failure.

BRIEF DESCRIPTION OF THE DRAWINGS

FIG. 8(*b*) is an enlarged view of a nozzle for the first head portion;

FIG. 8(*c*) is an enlarged view of the nozzle for the second head portion.

Corresponding reference characters indicate corresponding parts throughout the several views of the drawings.

DETAILED DESCRIPTION OF THE PREFERRED EMBODIMENTS

Figure 1:
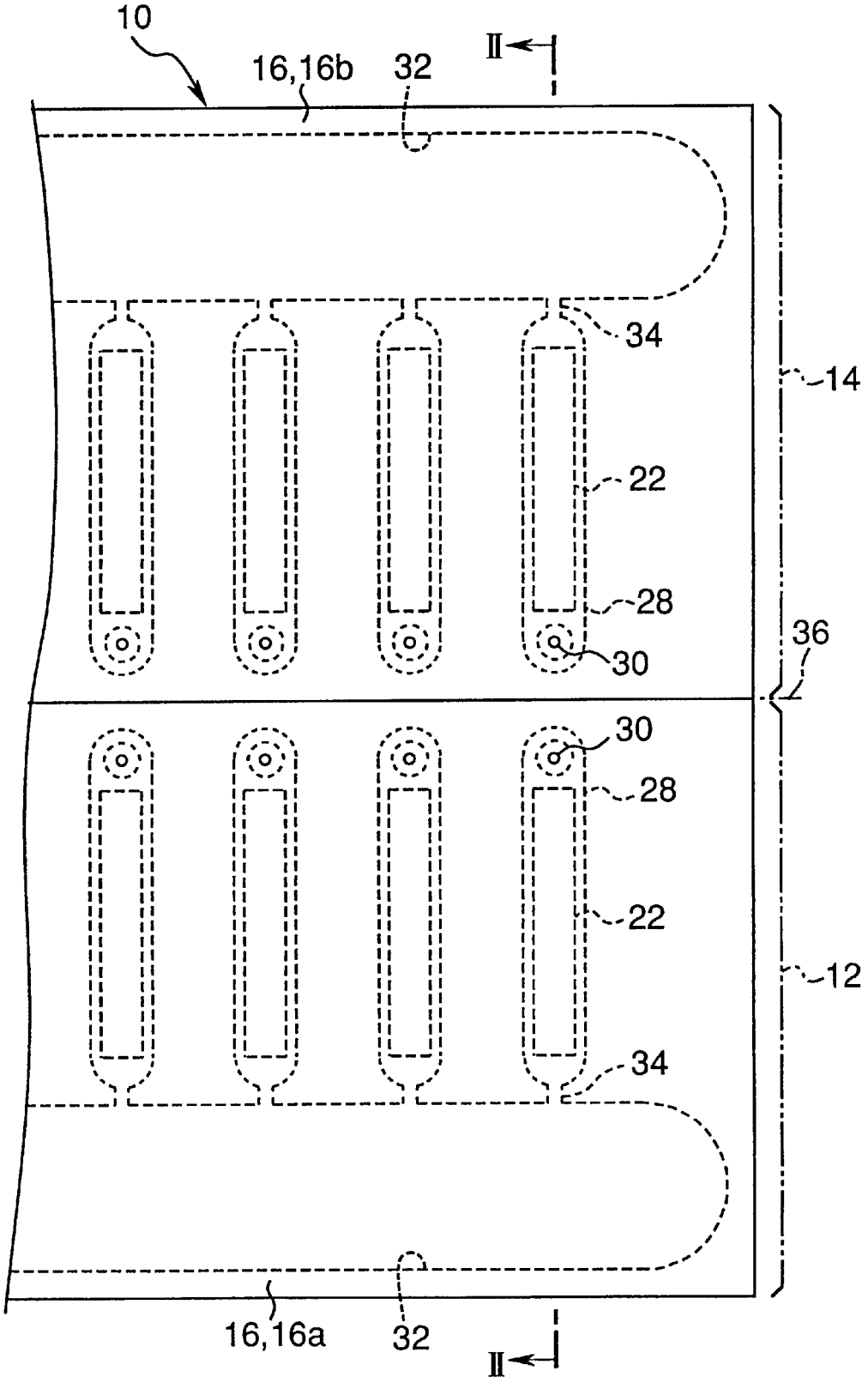
FIG. 1 is an enlarged plan view of the ink-jet recording head of the invention.
Figure 2:
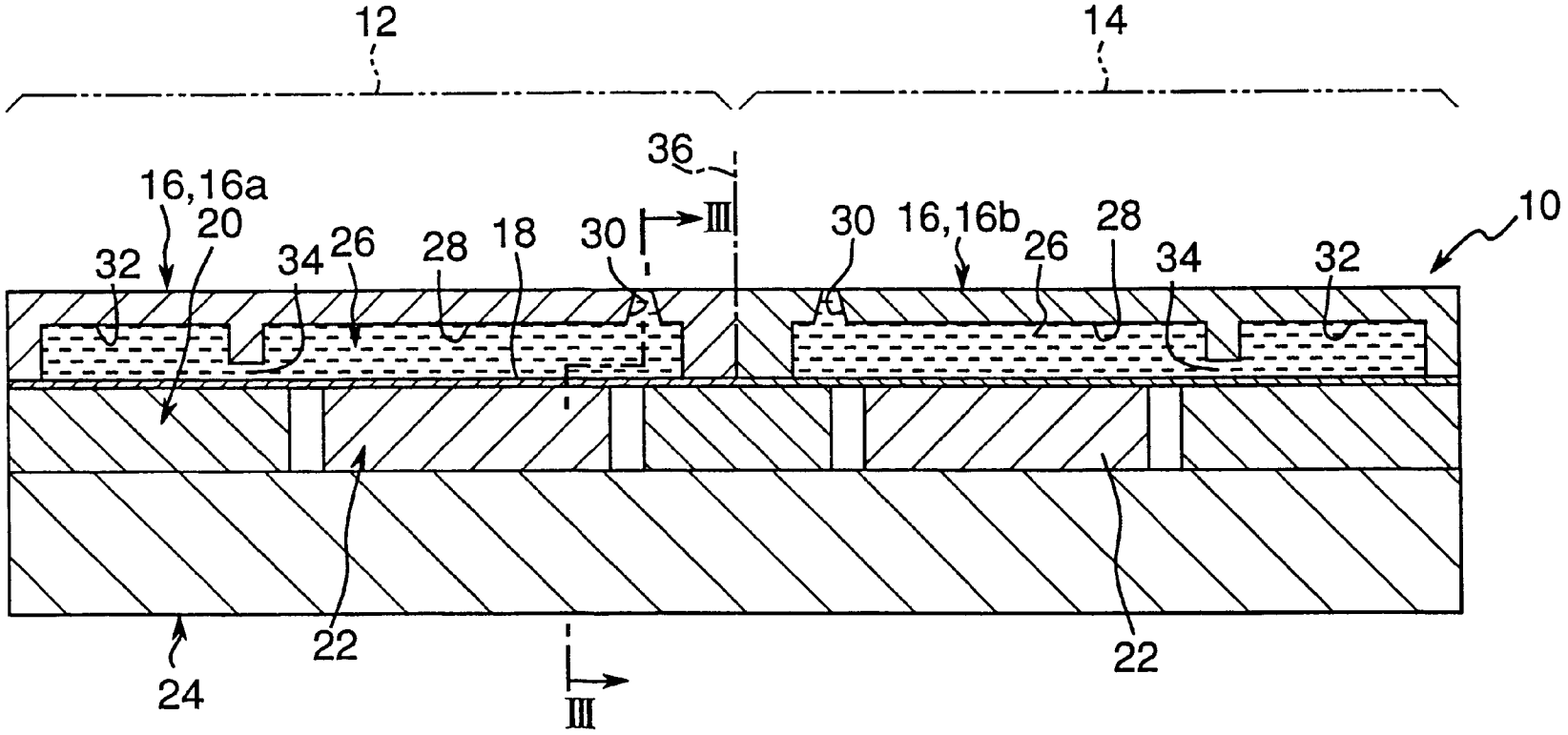
FIG. 2 is an enlarged cross sectional view of the ink-jet recording head taken along a line II—II in FIG. 1.
Figure 3:
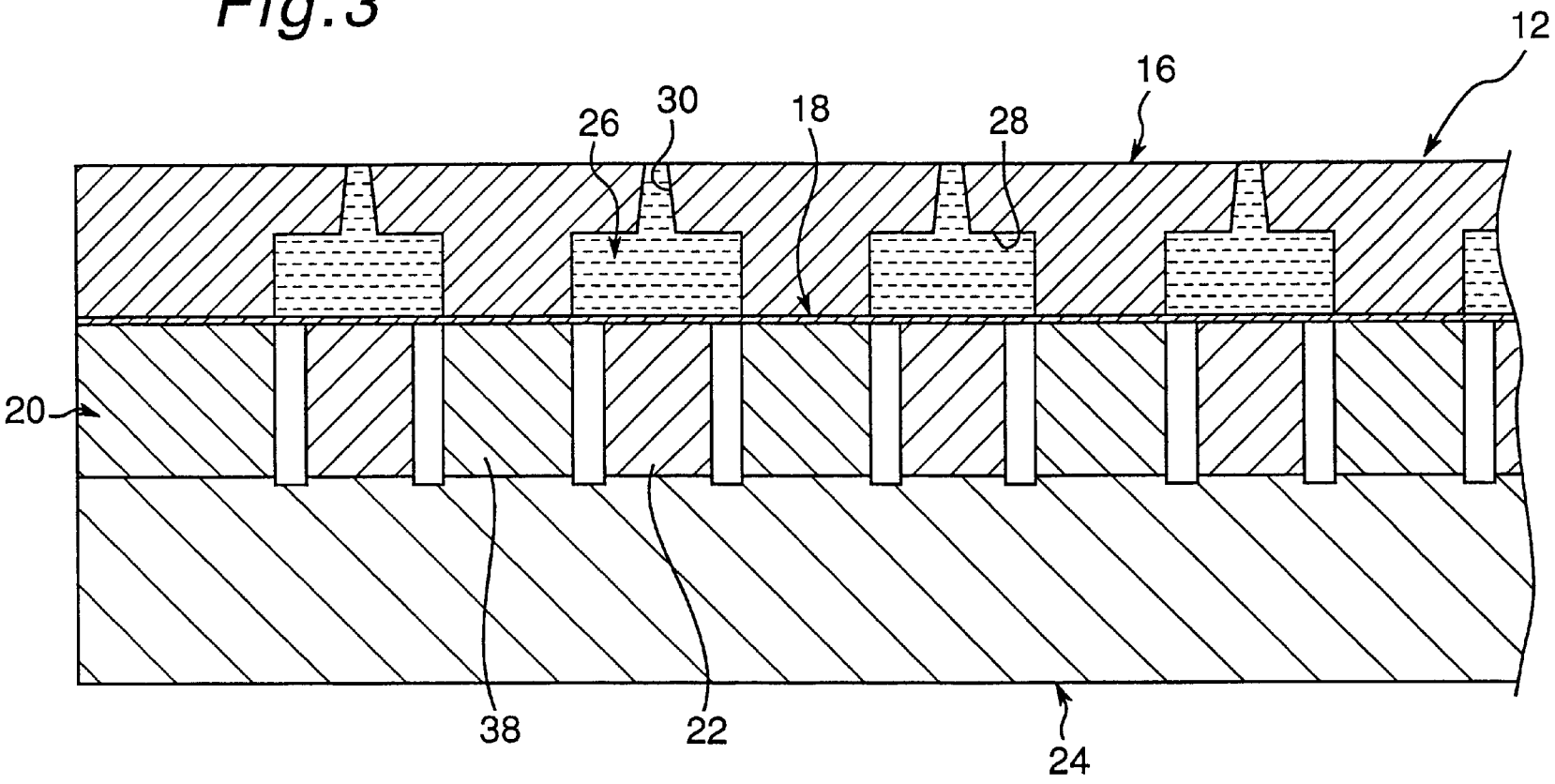
FIG. 3 is an enlarged cross sectional view of the ink-jet recording head taken along a line III—III in FIG. 2.

With reference to the drawings, particularly in FIGS. 1 to 3, an ink-jet recording device, generally indicated by reference numeral 10, for use in a Drop-on-Demand ink-jet recording head, includes a first head portion generally indicated by reference numeral 12 for ejecting first ink droplets and a second head portion generally indicated by reference numeral 14 for ejecting second ink droplets being smaller in size than the first ink droplets. First and second head portions are arranged symmetrically with respect to a central line 36 which extends therebetween. The first and second head portions 12 and 14 are constructed integrally by a cover plate 16, a diaphragm 18, frame 20, piezoelectric members 22 and a base plate 24.

The cover plate 16 comprises a first nozzle plate 16 for the first head portion 12, and a second nozzle plate 16 for the second head portion 14, which are arranged in parallel on the same plane. The first and second plates, 16*a* and 16*b*, are made of different materials so that the they have different contact angles against the same ink material. In this embodiment, for example, the first plate 16*a* is made of stainless steel having a first contact angle while the second plate 16*b* is made of fluorine resin having a second contact angle that is greater than the first contact angle of the first plate 16*a*.

Each of the first and second plates 16*a* and 16*b*, has a first surface (i.e., upper surface in FIGS. 2 and 3) away from the diaphragm 18 and a second surface (i.e., lower surface in FIGS. 2 and 3) adjacent to the diaphragm 18. Each of the second surface of the plates 16*a* and 16*b* includes a plurality of concave portions preferably formed by etching, lithography, or photolithography. On the second surface of the plates 16*a* and 16*b*, the diaphragm 18 is bonded so as to form a plurality of chambers, i.e., elongated ink cavities 28 for containing an ink material 26. Also, formed in plates 16*a* and 16*b* are nozzles 30 for ejecting the ink material 26, ink supply chamber 32 for accommodating the ink material 26, ink inlets 34 communicating the associated ink cavities 28 with the ink supply chamber 32.

As best shown in FIG. 1, the ink cavities 28 in the first and second head portions 12 and 14 are in the form of elongated grooves extending in parallel in a direction along which the first and second head portions oppose to each other. The ink supply chamber 32 is preferably arranged away from the imaginary central line 36 between the first and second head portions 12 and 14 and further communicated with a ink reservoir which is not shown.

Further, in this embodiment, the nozzles 30 in the first and second head portions, 12 and 14, are designed to have the same diameter. Additionally, the configuration and dimension of the ink cavity 28, ink inlet 34, piezoelectric member 22 and the like in the first head portion 12 are the same as those of the corresponding portions in the second head portion 14. That is, the only difference between the first and second head portions 12 and 14 is the material of the plates 16*a* and 16*b*.

The diaphragm 18, preferably made from a film of metal or synthetic resin, is secured between the cover plate 16 and the frame 20. Preferably, the diaphragm 18 is stretched at its fixed position.

The frame 20, preferably made of metal, synthetic resin, or ceramic, is secured between the diaphragm 18 and the base plate 24. The frame 20 comprises an outer frame portion running along the peripheral edge of the head 10 and a central frame portion running along the central line 36 so that two chambers are symmetrically formed for the first and second head portions 12 and 14, respectively. In each chamber, the piezoelectric members 22 are arranged in a parallel relationship with the corresponding ink cavities 28, respectively.

Preferably, the piezoelectric member 22 is a known multiple layered piezoelectric member in which a plurality of piezoelectric sheets and electrode layers, i.e., common and individual electrodes, are superimposed alternately. Arranged between the neighboring piezoelectric members 22 is the partition 38. The piezoelectric members 22 and partitions 38 are formed by fixing a piezoelectric plate on the base plate 24 and then cutting it by a known dicing technique. Then, the piezoelectric members are polarized by the application of a high voltage on the opposing electrodes under an elevated temperature. The frame 20 may be made from piezoelectric plate together with the piezoelectric members 22 and partitions 38.

Alternatively instead of a multiple layered piezoelectric member, a single layer piezoelectric member consisting of a single piezoelectric sheet may be employed. In this instance, the electrodes are provided on opposite surfaces of the piezoelectric member confronting the diaphragm 18 and base plate 24, respectively. The electrodes may be formed on the diaphragm and base plate so that they can contact with the opposite surfaces of the piezoelectric member, respectively.

The base plate 24, preferably made of ceramic, metal, or synthetic resin, is bonded on the frame 20 by a suitable adhesive.

The ink material is fed from the reservoir (not shown) to the ink supply chambers 32 and then distributed through the ink inlets 34 to the corresponding ink cavities 28.

In operation, when a circuit (not shown) for controlling an image data applies a certain voltage, i.e., print signal, on the piezoelectric member 22, the piezoelectric member 22 deforms toward the corresponding ink cavity 28. The deformation of the piezoelectric member 22 is transmitted to the diaphragm 18, which pressurizes the ink material 28 in the adjacent to ink cavity 28 to eject an ink droplet through the nozzle 30.

Figure 4A:
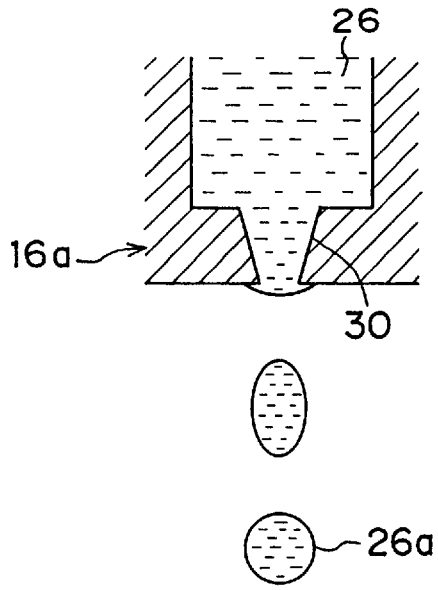
FIGS. 4A and 4B are enlarged cross sectional view of the nozzle of the first and second head portions and the ink droplets ejected therefrom.
Figure 4B:
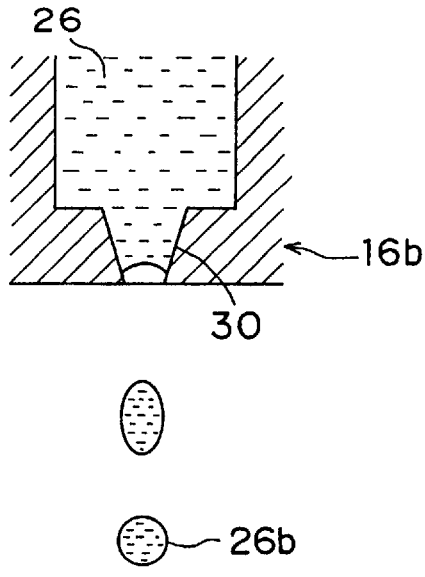

As described above, the nozzle plate 16*a* of the first head portion 12 is made from stainless plate having the first contact angle while the nozzle plate 16*b* of the second head portion 14 is made from fluorine resin plate having the second contact angle that is greater than the first contact angle. As a result, the wettability of the nozzle plate 16*a* of first head portion 12 is greater than the wettability of the nozzle plate 16*b* of the second head portion 14. Thus, as shown in FIG. 4A, in the first head portion 12, a free surface of the ink material 26 in the vicinity of nozzle 30 extends out of the distal end of the nozzle 30 and onto a peripheral surface portion surrounding the distal edge of the nozzle 30. Contrary to this, as shown in FIG. 4B, in the second head portion 14, a free surface of the ink material 26 in the vicinity of nozzle 30 settles within the nozzle 30.

As a result, the ink droplet 26*b* ejected from the nozzle 30 of the second head portion 14 has a diameter almost equal to the inner diameter of the distal end portion of the nozzle 30 while the ink droplet 26*a* ejected from the nozzle 30 of the first head portion 12 has a diameter larger than that of the ink droplet 26*b*. Therefore, selectively using first or second head portion 12 or 14 and further changing the voltage to be applied to the piezoelectric members 22 will enable the device to change the tone gradation widely, thereby enhancing the ability to form a picture-like halftone image.

Also, as the first and second head portions have the same configuration and dimension and the only difference exists in the materials of the plates 16*a* and 16*b*, the same machining tool and equipment can be used for the manufacturing of the corresponding portions of the first and second head portions.

Although the diameters of the nozzles 30 in the first and second head portions 12 and 14 are the same, they may also be different from each other, further improving the tone gradation of the device.

Two tests were conducted to evaluate the relationship between the voltage applied and the ink droplet diameter, for the first and second head portions.

Test 1: The nozzle plate for the first head portion was cut from a plate of stainless steel (SUS304) (Material A), having a thickness of 100 micro meters and a contact angle of about 60 degrees against the standard water based ink material. The nozzle plate for the second head portion was cut from a plate of a fluorine resin (Material B) having a thickness of 100 micro meters and a contact angle of about 100 degrees against the same. For the resin plate, a hydrophilic coating was provided by aurum deposition in the vicinity of the ink inlets to ensure the smooth entering of the ink material into the ink cavities. The nozzles having the same diameter of 40 micron meters were formed in the cover plates of the first and second head portions. A pulsating wave having a frequency of 4 kHz and a peak voltage of 10 to 50 volts was biased to the piezoelectric members.

Figure 5:
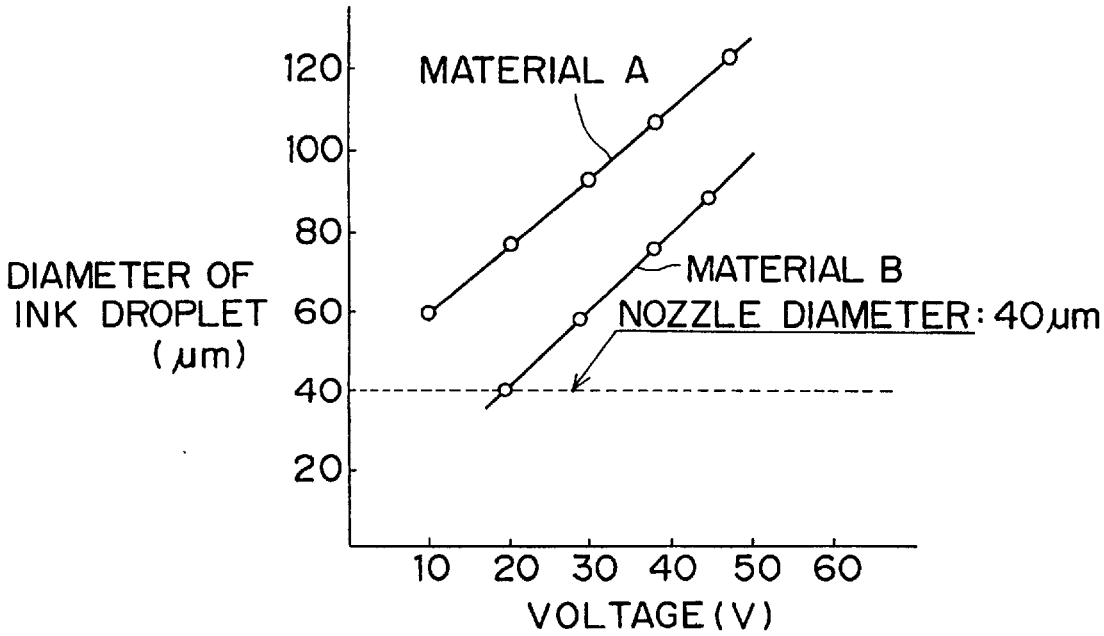
FIG. 5 is a graph which shows a relationship between the applied voltage and the diameter of the ink droplet for the first and second head portions.

The results of the first test are illustrated in FIG. 5. The results show that, when biasing the same voltage to the piezoelectric members, the first head portion having a plate is made of material A (stainless steel) and having a smaller contact angle (higher wettability), can eject ink droplets having larger diameter than the ink droplets ejected from the second head portion in which the nozzle plate is made of material B (fluorine resin) having larger contact angle (lower wettability).

Additionally, within a certain voltage range, the first and second head portion can change the diameter of the ink droplet in five and four steps. Therefore, by the combinations of the ink droplets ejected from the first and second head portions, six or seven tone gradations can be achieved.

Figure 6:
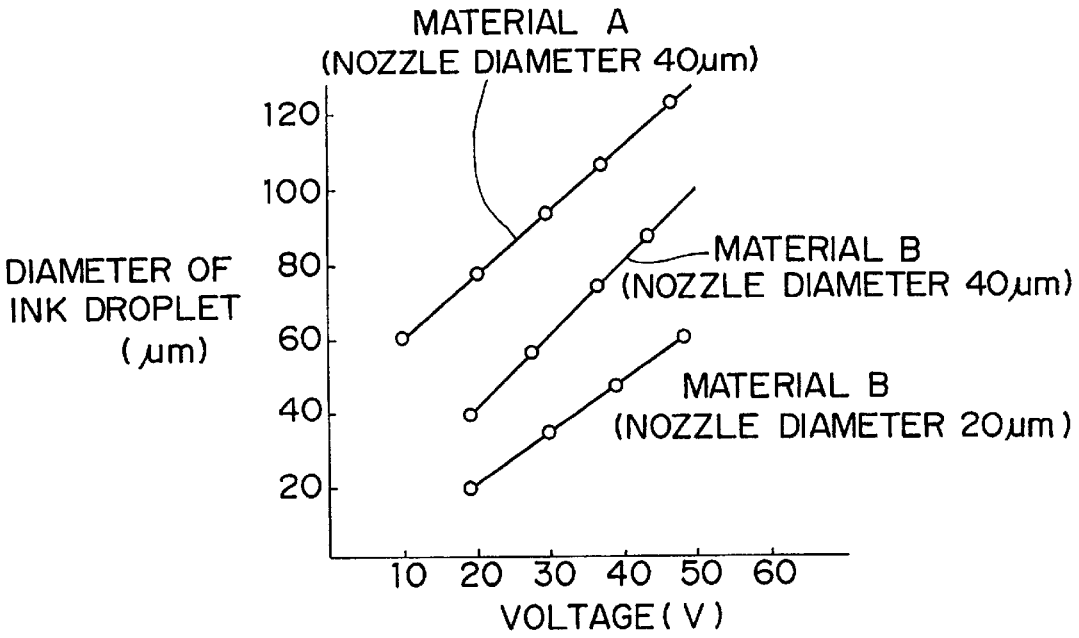
FIG. 6 is a graph which shows a relationship between the applied voltage and the diameter of the ink droplet for three nozzle plates having different wettabilities and nozzle sizes.

Test 2: A nozzle 20 micro meters in diameter was formed in the nozzle plate for the second head portion. Other conditions were the same as the first test. The results are illustrated in FIG. 6 in which the results of the test 1 are also illustrated for comparison. This shows that using three nozzle plates; stainless steel plate having nozzles of 40 micro meters in diameter, fluorine resin plate having nozzles of 40 micro meters in diameter, and fluorine resin plate having nozzles of 20 micro meters in diameter, will enable the ink-jet recording head to change the tone gradation in 8 or 9 steps.

In view of above, constituting the nozzle plates from different materials having respective wettabilities or repellent characteristics against the ink material and further varying the diameters of the nozzles for respective head portions will result in a wide range of tone gradation, allowing the device to print the picture-like halftone image.

The repellent characteristic of the plates can be differed by adding different additives into the same substrate. For example, polysulfonic acid resin having the standard contact angle of about 60 degrees is used for the nozzle plate of first head portion while polysulfonic acid resin in which small glass beads are dispersed is used for the nozzle plate of the second head portion and the contact angle of the second nozzle plate is increased up to 100 degrees by providing a coupling treatment on its surface with fluorosilicone resin and the like.

Similarly, the repellent characteristic can be controlled by providing the base material (e.g., resin or metal) of the nozzle plate with additives having different wettabilities.

Figure 7A:
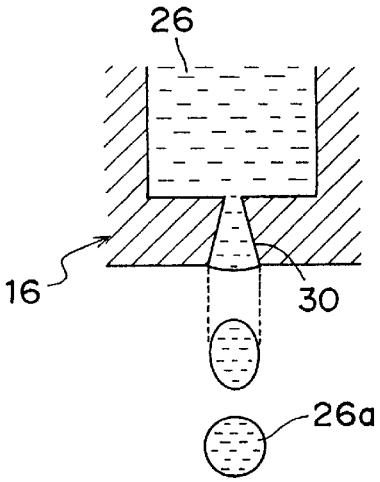
FIG. 7 is an enlarged cross sectional view of the nozzle of the first and second head portions in which the nozzles are tapered inwardly.
Figure 7B:
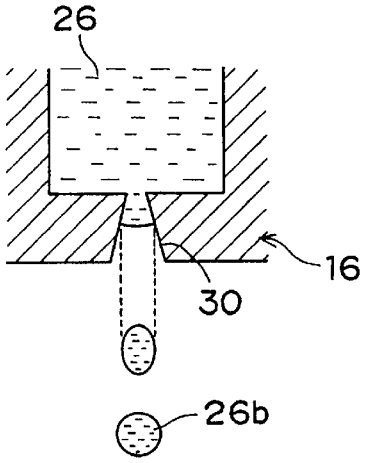

Although the nozzle of the head in the previous embodiment is tapered outwardly, it may be tapered inwardly as shown in FIGS. 7A and 7B. In this case, the diameter of the ink droplet can be changed so widely.

Also, to provide the ink droplets ejected from different head portions with a clear difference in diameter between them and thereby to increase the number of tone gradation, it is preferable that a contact angle of one nozzle plate should be differed by 5 degrees, more preferably 10 degrees, from that of the other nozzle plate.

Figures 8A, 8B, 8C:
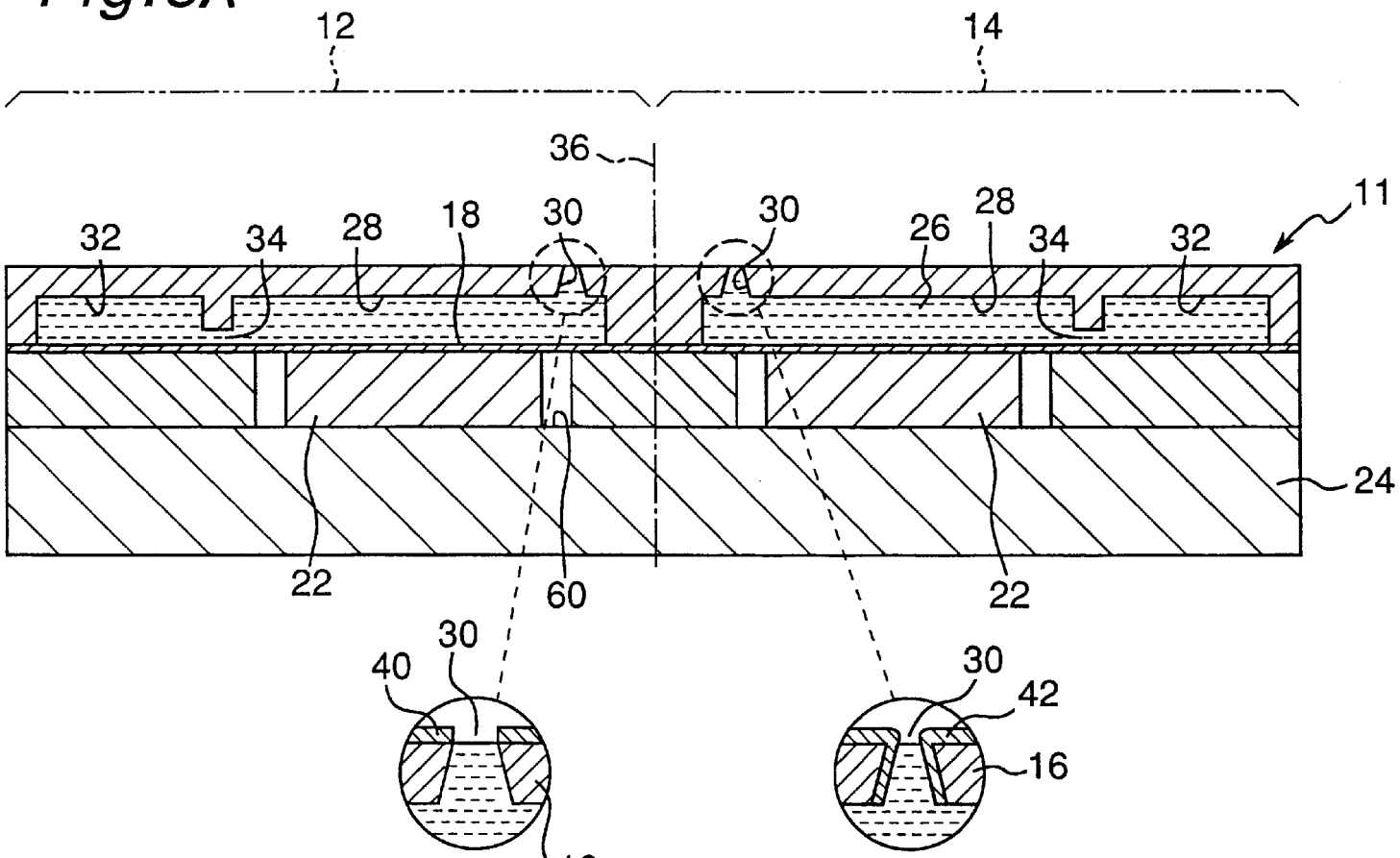
FIG. 8(*a*) is an enlarged cross sectional view of the head according to another embodiment of the invention.

Referring to FIG. 8(*a*)–8(*c*), there is shown an ink-jet head 11 of the second embodiment. The ink-jet head 11 is similar in construction to the ink-jet head 10, except for the following enumerated differences. Specifically, the cover plate 16 is made from a single plate of metal such as nickel. The first surface, i.e., upper surface in FIG. 8, of the cover plate 16 in the first head portion 12 is provided with a water repellent layer 40 by an application of a coating material which is commercially available under the tradename CYTOP from ASAHI GLASS CO., which increases the contact angle of the surface against the ink material up to 87 degrees and thereby provides a higher repellent characteristic to the surface. This prevents the unwanted dropping and/or leaking of the ink material due to a residual vibration of the nozzle after the completion of the ink ejection. In contrast, it is preferable to decrease the contact angle of the inner surface of the nozzle 30 and thereby to increase the hydrophilic characteristic thereof so that the ink material will be supplied rapidly to the nozzle 30 after the ink ejection. In this embodiment, however, the cover plate 16 is made of nickel which has a lower contact angle against the ink material of about 32 degrees and therefore such surface coating is not needed for the inner surface of the nozzle 30.

For the second head portion 14, on the other hand, a hydrophilic layer 42 is provided on the outer surface of the cover plate 16 and the inner surface of the nozzles 30 by the application of a suitable material such as polyimide, thereby providing a contact angle of 67 degrees thereon to ensure the smooth ink ejection therethrough.

The repellent layer 40 may be provided by filling the nozzles 30 with a suitable hot melt wax, spraying the coating material onto the surface of the cover plate 16, and finally melting the filled wax to eliminate it from the nozzle 30. Alternatively, the repellent layer 40 may be formed by spraying the coating material on the surface of the cover plate 16 of the first head portion 12, and forming the nozzles by the exposure of an excimer laser and the like in the cover plate 16.

The hydrophilic layer 42 may be provided by forming nozzles 30 in the cover plate 16 of the second head portion 14 by the exposure of the excimer laser and the like, and applying the coating material on the outer surface of the cover plate 16 and the inner surface of the nozzles 30.

With this arrangement, due to the repellent layer 40, no further ink material is dropped or discharged from the nozzles 30 in the first head portion 12 even if the nozzle 30 would continue to vibrate after the ink ejection. The repellent layer 40 stabilizes the free surface or meniscus of the ink material in the nozzles 30 and prevents a scattering of the ink material and an oblique propelling of the ink droplet, which ensures that head 11 prints a high quality image.

Further, as the hydrophilic surface is also provided on the inner surface of the nozzles 30, the ink material can be fed to the interior of the nozzle 30 continuously. This permits the head 11 to reproduce high quality images even if a large number of ink droplets are ejected in a relatively short span of time.

Furthermore, as the inner surface of the nozzle 30 in the second head portion 14 is covered with hydrophilic layer 42, a smooth ink ejection from the nozzles 30 and a smooth ink supply to the nozzles 30 are ensured.

It should be understood that the ink material may be a black or color ink. When using color ink, although the diameter of the ink droplet is determined by taking the difference of reflective densities of the ink materials to be used, the repellent layer 40 or hydrophilic layer 42 may be provided to the head portion for color ink material, which increases the quality of the resultant color image.

Tests were conducted to determine the coating material. Five cover plates A to E, each laving a thickness of 90 micron meters, were provided. The nozzles were formed in the plates to have a diameter of 23 micron meters. The outer surface of the plate and each inner surface of the nozzle were applied with coating materials listed in the following table 1, respectively:

TABLE 1

| | COATING MATERIAL | |
|---|---|---|
| | OUTER SURFACE OF COVER PLATE | INNER SURFACE OF NOZZLE |
| A | CYTOP | CYTOP |
| B | CYTOP | — |
| C | — | — |
| D | POLYIMIDE | POLYIMIDE |
| E | POLYIMIDE | — |

Contact angles of respective portions measured is listed in the following table 2:

TABLE 2

| | CONTACT ANGLE (DEGREES) | |
|---|---|---|
| | OUTER SURFACE OF COVER PLATE | INNER SURFACE OF NOZZLE |
| A | 87 | 87 |
| B | 87 | 32 |
| C | 32 | 32 |
| D | 68 | 68 |
| E | 68 | 32 |

Physical properties and compositions of the ink material used are shown in the following table 3:

TABLE 3

| | |
|---|---|
| Surface tension | 30 dyn/cm |
| Viscosity | 2.5 cp |
| $H_2O$ | 73 (wt %) |
| Diethyleneglycol | 12 (wt %) |
| Triethyleneglycolmonobutylether | 7 (wt %) |
| Polyethyleneglycol | 5 (wt %) |
| Dye | 3 (wt %) |

(i) Dropping and leaking of the ink material, (ii) variation range of diameter of dot, and (iii) Ink supply delay to the nozzle were evaluated for cases in which 20 volts and 10 volts were applied for ejecting ink droplets of about 100 micro meters as large dot and about 45 micro meters as small dot in diameter, respectively.

The dropping and leaking of the ink material was viewed if the ink material has dropped or leaked from the nozzles. The result is shown in the following table 4:

TABLE 4

| | Dropping and leaking of ink material | |
|---|---|---|
| | LARGE DOT | SMALL DOT |
| A | I | I |
| B | I | I |
| C | III | II |
| D | I | I |
| E | I | I |

I: No ink dropped or leaked
II: No ink dropped or leaked but ink surface vibrated
III: Ink dropped and/or leaked The variation of the dot diameter was evaluated by viewing the dots formed on a sheet by the use of a micrography. The results is shown in the following table 5:

TABLE 5

| | Variation of dot diameter | |
|---|---|---|
| | LARGE DOT | SMALL DOT |
| A | II | II |
| B | I | III |
| c | III | III |
| D | III | I |
| E | III | III |

I: Within ±5 $\mu$m
II: Under ±15 $\mu$m
III: More than ±15 $\mu$m

Ink supply delay was evaluated by forming 1,000 ink dots continuously to draw a line at a frequency of 4 kHz and then counting the number of failures of dots. The result is shown in the following table 6:

TABLE 4

| | Ink supply delay | |
|---|---|---|
| | LARGE DOT | SMALL DOT |
| A | III | III |
| B | I | I |
| C | I | I |
| D | III | I |
| E | I | I |

I: No failure of dots
II: Three or less
III: Four or more

As can be seen from tables 4 to 6, the plate B is evaluated as best for every test items (i) to (iii) for large dot printing. The reason is that ejecting large ink droplet requires more ink material and therefore the contact angle of the inner surface of the nozzle needs to be smaller for smooth ink supply and the contact angle of the outer surface of the cover plate needs to be larger to prevent dropping or leaking of ink material possibly caused by the residual vibration of the nozzle after ink ejection.

For forming small dots, the plate B is evaluated as best. The reason is that greater contact angle of the plate will make it difficult for nozzle to eject small ink droplets.

Based upon the above tests, it has been found that nickel and CYTOP or polyimide are suitable as the material of the ink-jet head 11 and the coating material, respectively, however, the invention is not limited to this combination. For example, the cover plate is made of stainless steel or polyimide and a coating is made by a eutectoid plating of perphloroacrylate and metal on the plate. In this instance, the contact angle of the cover plate can be increased by about 15 to 60 degrees by the eutectoid plating. As described, a desired contact angle can be provided with the cover plate by the known coating technique such as application and plating.

Although the present invention has been fully described by way of examples with reference to the accompanying drawings, it is to be noted that various changes and modifications will be apparent to those skill in the art. Therefore, unless otherwise such changes and modifications depart from the scope of the present invention, they should be construed as being included therein.

What is claimed is:

1. An ink-jet recording head for ejecting an ink material through a nozzle to deposit the ink material onto a recording medium, comprising:

a first head member in which a first nozzle is formed; and a second head member in which a second nozzle is formed, wherein said first and second head members are made of materials having different ink repellent characteristics against said ink material.

2. An ink-jet recording head in accordance with claim 1, wherein said ink material and said material of said first head member have a first angle of contact therebetween and said ink material and said material of said second head member have a second angle of contact therebetween and wherein a difference of said repellent characteristics of said first and second head members is five degrees or more between said first angle of contact and said second angle of contact.

3. An ink-jet recording head in accordance with claim 1, wherein said first and second nozzles have substantially equivalent diameters.

4. An ink-jet recording head in accordance with claim 1, wherein said first and second nozzles have different diameters.

5. An ink-jet recording head in accordance with claim 1, wherein said first and second nozzles are tapered outwardly.

6. An ink-jet recording head in accordance with claim 1, wherein said first and second nozzles are tapered inwardly.

7. An ink-jet recording head in accordance with claim 1, wherein said ink material and said material of said first head member have a first angle of contact therebetween and said ink material and said material of said second head member have a second angle of contact therebetween and wherein a difference between said first angle of contact and said second angle of contact is ten degrees or more.

8. An ink-jet recording head for ejecting an ink material to deposit the ink material onto a recording medium, comprising:

a first head member in which a first nozzle is formed; and a second head member in which a second nozzle is formed, wherein a first surface portion of said first member which extends around and adjacent to a distal end of said first nozzle is formed of an ink repellent material, and a second surface portion of said second member which extends around and adjacent to said distal end of said second nozzle is formed of a hydrophilic material.

9. An ink-jet recording head in accordance with claim 8, wherein an angle of contact between said ink material and said ink repellent material is greater than an angle of contact between said ink material and said hydrophilic material.

10. An ink-jet recording head for ejecting an ink material onto a recording medium comprising:

a first head member made of a first material in which a first nozzle is formed;

a second head member made of a second material in which a second nozzle is formed;

wherein a first angle of contact between said ink material and said first material is different than a second angle of contact between said ink material and said second material.

* * * * *

UNITED STATES PATENT AND TRADEMARK OFFICE

CERTIFICATE OF CORRECTION

PATENT NO. : 6,042,219

DATED : March 28, 2000

INVENTOR(S) : Kusunoki Higashino, et al.

It is certified that error appears in the above-identified patent and that said Letters Patent is hereby corrected as shown below:

Column 1, line 38, change "objet" to --object--.

Column 5, line 12, change "micron" to--micro--.

Column 7, line 10, change "micron" to--micro--.

Column 7, line 11, change "micron" to--micro--.

Signed and Sealed this

Twenty-sixth Day of December, 2000

*Attest:*

Q. TODD DICKINSON

*Attesting Officer*

*Director of Patents and Trademarks*